US006328591B2

(12) United States Patent
Ushio et al.

(10) Patent No.: US 6,328,591 B2
(45) Date of Patent: Dec. 11, 2001

(54) RECEPTACLE TYPE CONNECTOR AND PLUG TYPE CONNECTOR

(75) Inventors: Kohei Ushio; Yutaka Ushiro, both of Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/832,891

(22) Filed: Apr. 12, 2001

(30) Foreign Application Priority Data

Apr. 13, 2000 (JP) ..... 12-112319

(51) Int. Cl.[7] ..... H01R 13/64
(52) U.S. Cl. ..... 439/374; 439/660
(58) Field of Search ..... 439/660, 374, 439/677

(56) References Cited

U.S. PATENT DOCUMENTS 4,678,121 * 7/1987 Douty et al. ..... 439/660
5,267,881 * 12/1993 Matuzaki ..... 439/660
5,277,597 * 1/1994 Masami et al. ..... 439/660
5,613,881 * 3/1997 Ichida et al. ..... 439/374

* cited by examiner

*Primary Examiner*—Renee Luebke
*Assistant Examiner*—Briggitte R. Hammond
(74) *Attorney, Agent, or Firm*—Oblon, Spivak, McClelland, Maier & Neustadt, P.C.

(57) ABSTRACT

A contact holding wall and the groove-shaped guide wall of the plug type connector are respectively inserted into and strongly connected with a primary inserting and drawing recess and a groove-shaped subsidiary inserting and drawing recess of a receptacle type connector. The housing of each connector has a portion surrounding the periphery of a contact holding wall. A longitudinal rib formed on the inner face of a side wall section of the receptacle type connector is engaged with a longitudinal groove of a predetermined depth formed on a side wall section of the plug type connector.

6 Claims, 7 Drawing Sheets

RECEPTACLE TYPE CONNECTOR AND PLUG TYPE CONNECTOR

BACKGROUND OF THE INVENTION

1. Field of the Invention

The present invention relates to a receptacle type connector and plug type connector which are connected with and disconnected from each other when a maintenance part of an image forming device of a copier, facsimile terminal equipment or printer, for example, a toner cartridge is attached to and detached from the image forming device.

2. Description of the Related Art

For example, when a toner cartridge is attached to or detached from an image forming device body, connectors for supplying electric power or transmitting signals are simultaneously connected together with the toner cartridge. Conventionally, the toner cartridge is inserted into and drawn out from the image forming device body in the lateral direction. Therefore, it is common that the inserting and drawing direction of the toner cartridge coincides with the inserting and drawing direction of the connectors.

On the other hand, from the viewpoint of improving the layout of parts arranged in an image forming device, it is desirable that both connectors are inserted into and drawn out from each other when the toner cartridge is moved upward and downward in the image forming device. In this case, the plug type connector is arranged on a side plate of the toner cartridge (what is called a side type) and the receptacle type connector is arranged in an image forming device body.

In this connection, when a used toner cartridge is replaced with a new one, both the connectors are separated from each other. In this case, in order to prevent the contacts of each connector from being damaged when they come into contact with external foreign objects, it is necessary to protect the contacts. Therefore, the essential profile of the housing of each connector is formed into a box-shape surrounding the periphery of a group of contacts.

However, when both the connectors are connected with each other under the condition that the housings of both the connectors are formed into a perfect box-shape, for example, the plug type connector must be formed into an L-shape when it is viewed from the side, that is, the L-shaped portion greatly protrudes from the side of the toner cartridge. As a result, the size of the toner cartridge is increased.

In order to solve the above problems, it is possible to consider that one of the side walls of the housings of both the connectors is abolished or one side wall is provided independently from the other side wall. However, when the above structure is adopted, the connecting strength of the connectors is lowered, and the electrical continuity between the contacts might become unstable. Further, the contacts might not be sufficiently protected when both the connectors are disconnected from each other.

SUMMARY OF THE INVENTION

The present invention has been accomplished to solve the above problems. It is an object of the present invention to provide a receptacle type connector and plug type connector characterized in that: the size of the connecting structure can be reduced; the connecting strength can be enhanced; and the contacts can be sufficiently protected even when one connector is separated from the other connector.

In order to accomplish the above object, the invention described as a first aspect provides a receptacle type connector to which a plug type connector is connected or from which the plug type connector is disconnected when the plug type connector attached to a side of an object is raised or lowered, the receptacle type connector including:

a housing provided with a front wall section, rear wall section, right and left side wall section and intermediate wall section for holding contacts in parallel with the front and the rear wall section, wherein corners of longitudinal ribs respectively formed on inner faces of the right and left side wall sections connect corners of side edges of the front wall section with corners of corresponding side edges of the intermediate wall section, a primary inserting and drawing recess into which a contact holding wall of the plug type connector is inserted and from which the contact holding wall of the plug type connector is drawn out is defined by the front wall section, the intermediate wall section and the right and left longitudinal ribs, and a subsidiary inserting and drawing recess, the profile of which is a groove-shape, into which a guide wall of the plug type connector is inserted and from which the guide wall of the plug type connector is drawn out is defined by the rear wall section, the intermediate wall section, the right and left side wall sections, and the right and left longitudinal ribs.

In this structure, when the corners of the longitudinal ribs are connected with the corners of the corresponding side edges of the front wall section and the intermediate wall section, the structure to define each inserting recess can be made compact and the mechanical strength can be enhanced. The contact holding wall of the opponent plug type connector and the guide wall can be respectively inserted into the primary inserting and drawing recess and the groove-shaped subsidiary inserting and drawing recess and strongly connected. The primary inserting and drawing recess can be defined by the longitudinal ribs, front wall section and intermediate wall section which are connected with each other. Therefore, the contacts can be positively protected after the receptacle type connector has been disconnected from the plug type connector. Concerning the plug type connector, it is sufficient that the engaging grooves engaged with the longitudinal ribs are formed on the right and the left side wall. As a result, the connecting structure can be made compact.

The invention described as a second aspect provides a receptacle type connector according to the first aspect, wherein the longitudinal groove is defined by the side edge of the front wall section, the inner face of the side wall section opposing to the side edge and the longitudinal rib. In this structure, a portion of the side wall of the plug type connector can be introduced into these longitudinal grooves. Therefore, the connecting structure can be more enhanced.

The invention described as a third aspect provides a plug type connector combined with the receptacle type connector according to the first and second aspects, the plug type connector including: a housing provided with a front wall section, right and left side wall sections, contact holding wail which is parallel with the front wall section and inserted into and drawn out from the primary inserting and drawing recess of the receptacle type connector, and a lower wall section opposing to the front wall section with respect to the contact holding wall, wherein an opening edge section surrounding the periphery of the contact holding wall is formed by the front wall section, the right and left side wall sections and an end section of the lower wall section, an engaging groove extending from the opening edge section in parallel with a side end edge of the contact holding wall by a predetermined length is formed on the right and left side wall and the longitudinal ribs of the receptacle type connector are inserted into and drawn out from the engaging groove, a gap is formed between the edge section of an engaging groove and the side end edge of the contact holding wall opposing to it, and a first portion continuing to the front wall section in the first portion opposed to a second portion with respect to the engaging grooves of the right and the left side wall section is formed into a groove-shaped guide wall which is inserted into and drawn out from the subsidiary inserting and drawing recess of the receptacle type connector together with the front wall section in the case of combining the plug type connector with the receptacle type connector.

In this structure, the contact holding wall and the guide wall can be respectively inserted into the primary inserting and drawing recess and the groove-shaped subsidiary inserting and drawing recess of the receptacle type connector and strongly connected with each other. Since the periphery of the contact holding wall is surrounded by the front wall, lower wall and right and left side walls, the contacts can be positively protected after the plug type connector has been disconnected from the receptacle type connector. Since the engaging grooves are provided on the right and the left side wall section, it is unnecessary to form the housing into an L-shape. Therefore, the connecting structure can be compact.

The invention described as a fourth aspect provides a plug type connector according to the third aspect, wherein the second portion is inserted into and drawn out from the longitudinal groove of the receptacle type connector. In this structure, a portion of the right and left side walls is engaged with the longitudinal groove of the opponent connector, so that the connecting strength can be more enhanced.

DETAILED DESCRIPTION OF THE PREFERRED EMBODIMENTS

Referring to the appended drawings, a preferred embodiment of the present invention will be explained below.

Figure 1:
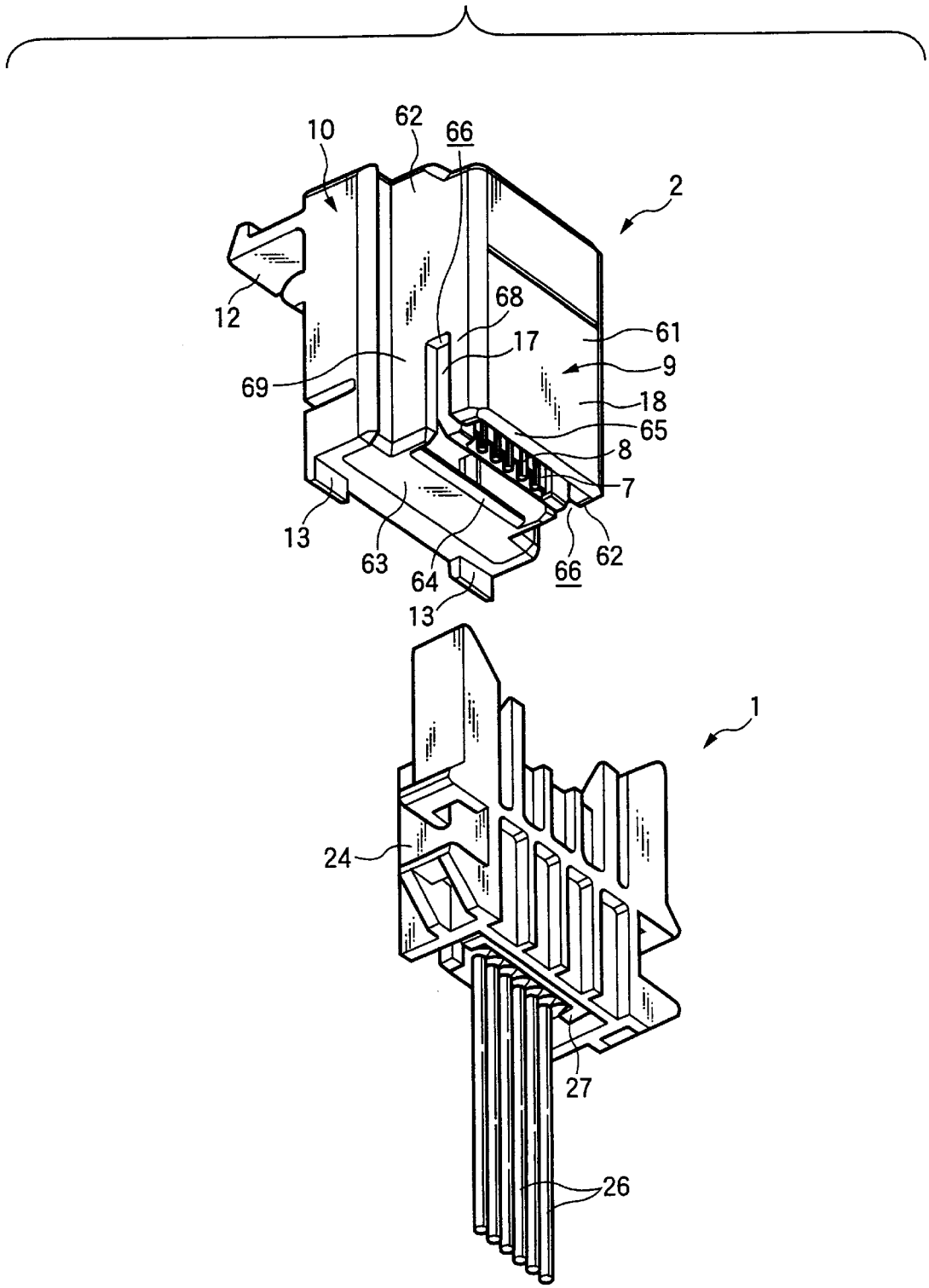
FIG. 1 is an exploded perspective view of a receptacle type connector of an embodiment of the present invention and a plug type connector 2 which forms a pair together with the receptacle type connector.
Figure 2:
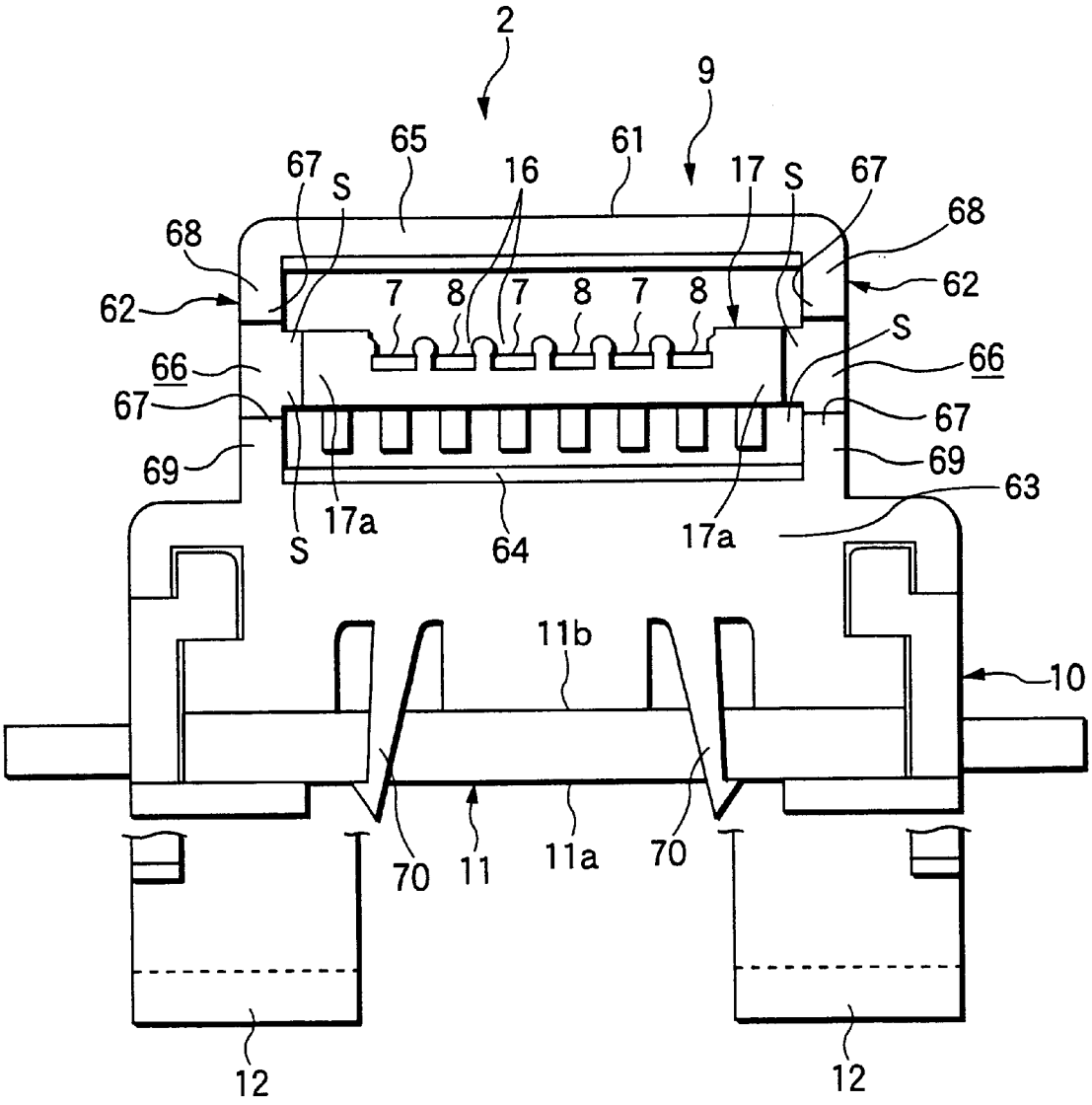
FIG. 2 is a lower face view showing an outline of a plug type connector.
Figure 3:
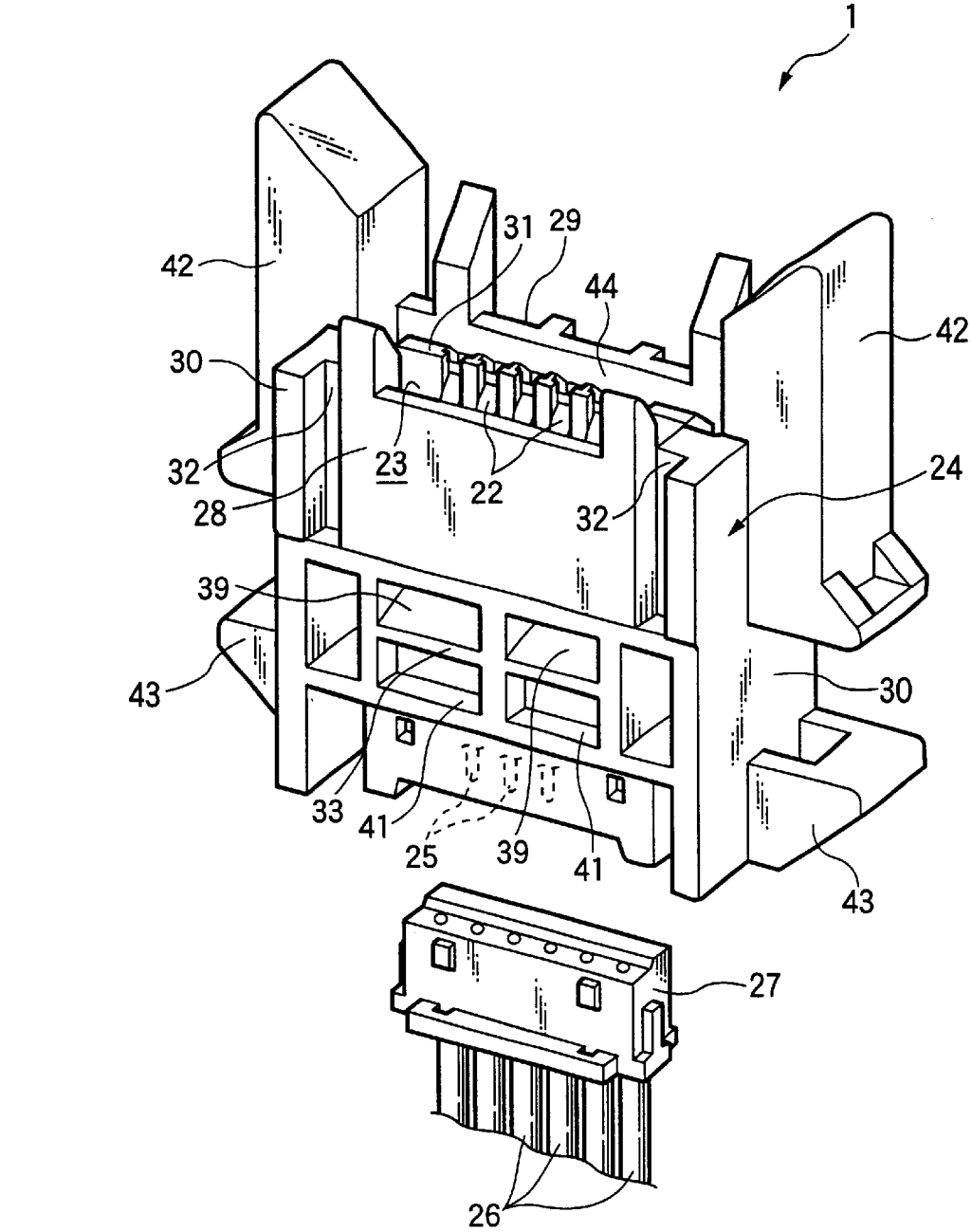
FIG. 3 is an exploded perspective view showing a receptacle type connector, wherein the view is taken from the back.
Figure 4:
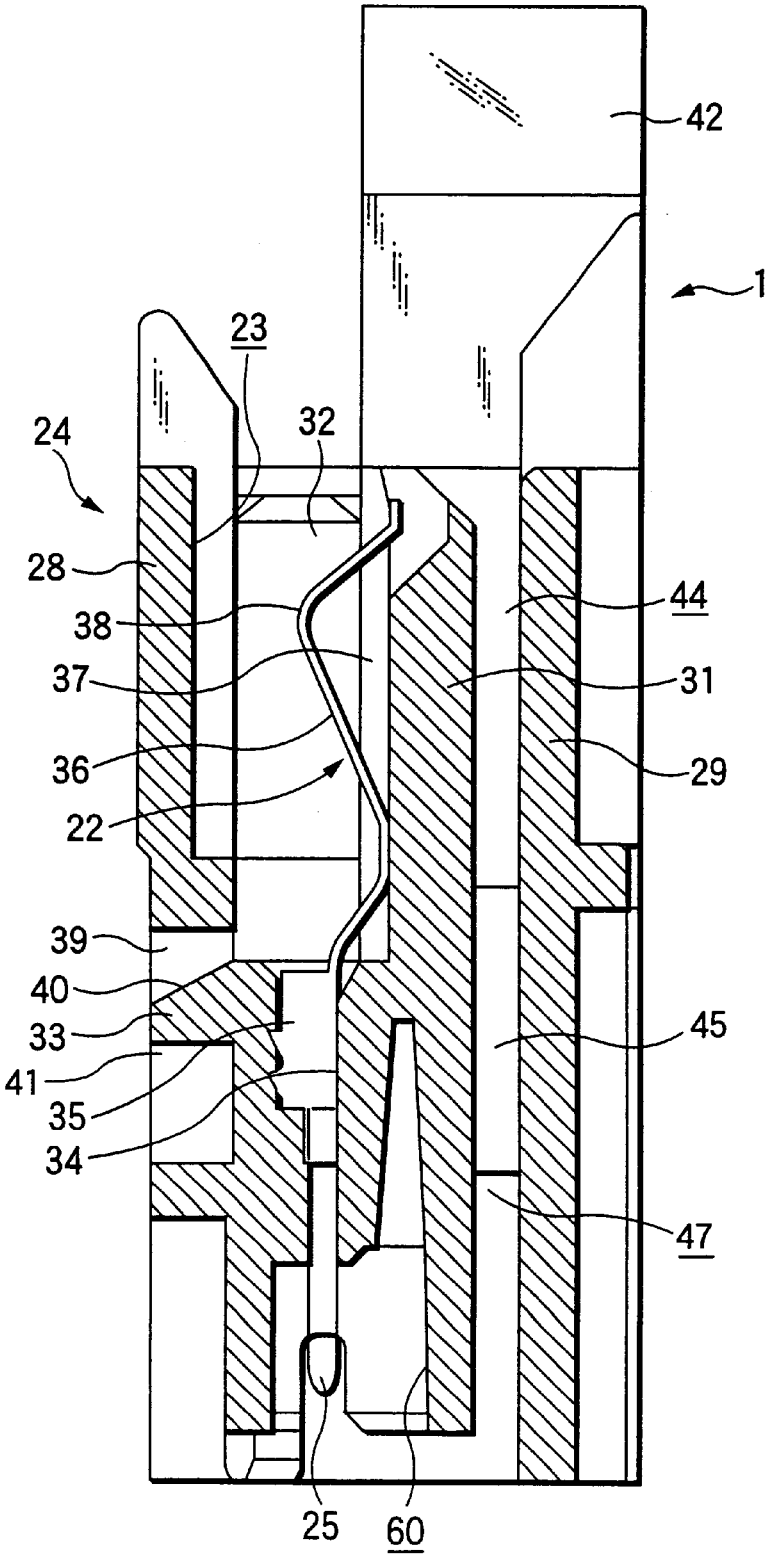
FIG. 4 is a longitudinal cross-sectional view showing a primary portion of a receptacle type connector.
Figure 5:
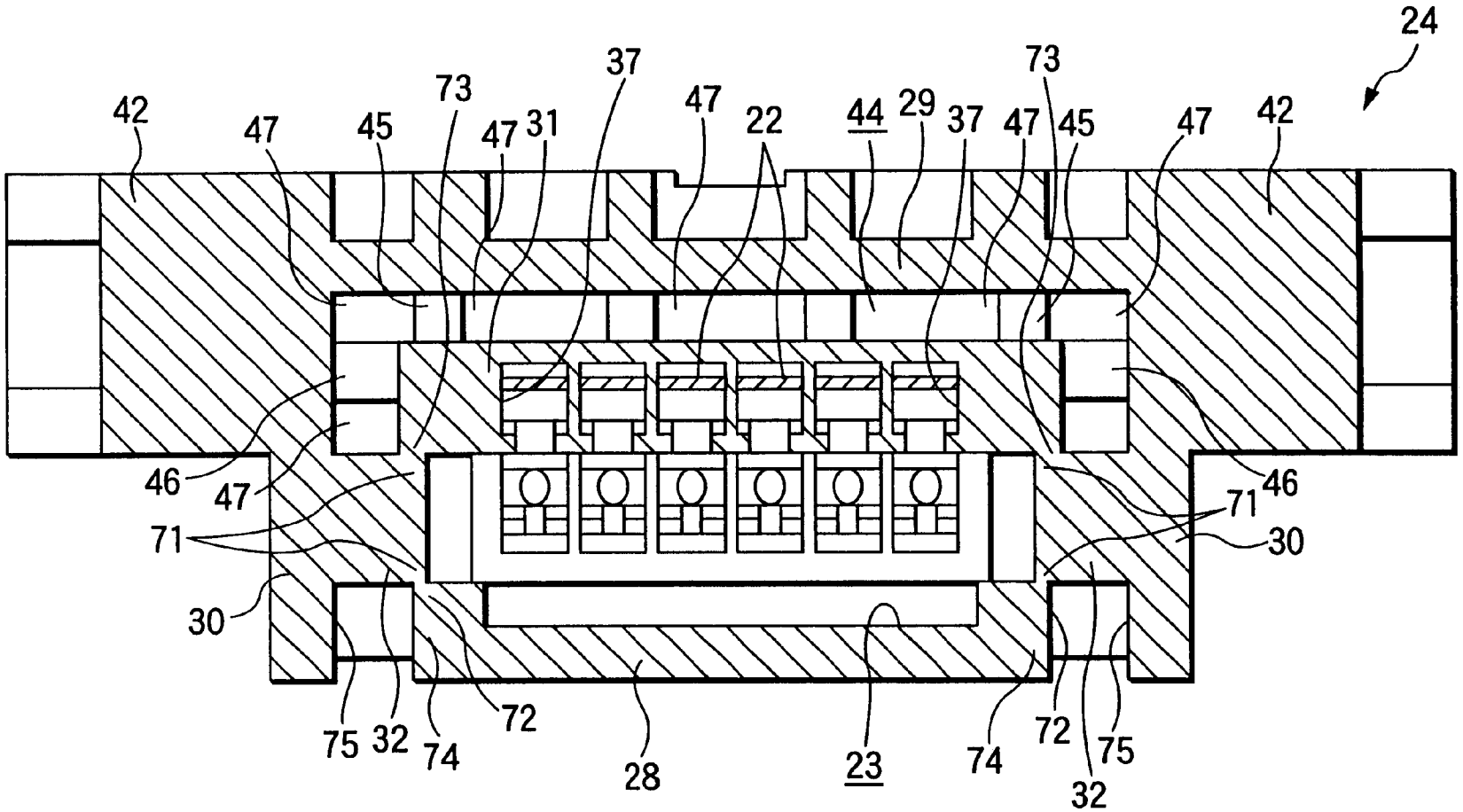
FIG. 5 is a lateral cross-sectional view showing a primary portion of a receptacle type connector.
Figure 6:
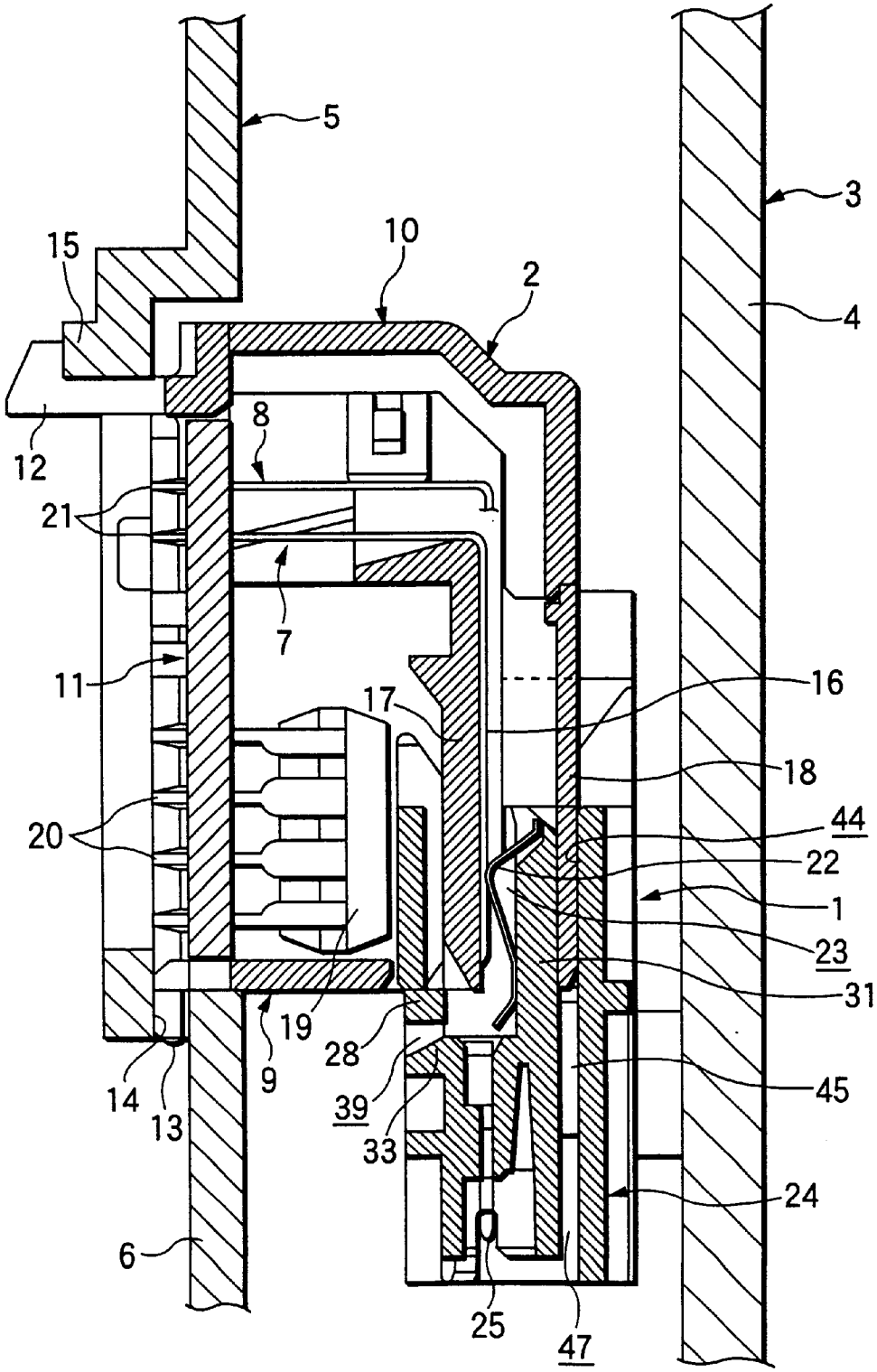
FIG. 6 is a longitudinal cross-sectional view showing of a receptacle type connector and a plug type connector which are combined with each other in an image forming device body.

FIG. 1 is an exploded perspective view of a receptacle type connector 1 of an embodiment of the present invention and a plug type connector 2 which forms a pair together with the receptacle type connector 1, FIG. 2 is a lower face view showing an outline of the lower face of the plug type connector, FIG. 3 is an exploded perspective view of the receptacle type connector 1 which is viewed from the back side, FIG. 4 is a longitudinal cross-sectional view of the receptacle type connector, FIG. 5 is a lateral cross-sectional view of the receptacle type connector, and FIG. 6 is a cross-sectional view of both the connectors which are connected with each other.

As shown in FIG. 6, the receptacle type connector 1 is fixed to the side plate 4 of the image forming device body 3. On the other hand, the plug type connector 2 is fixed to the side plate 6 of the toner cartridge 5 which is a maintenance part. When the toner cartridge 5 is attached to and detached from the image forming device body 3, both the connectors 1, 2 are connected with and disconnected from each other.

Referring to FIGS. 1, 2 and 6, the plug type connector 2 includes: a plug housing 9 for holding a plurality of angle-shaped contacts 7, 8 which are aligned in line; a cover housing 10 combined with this plug housing 9; and a circuit board 11 held by both the housings 9, 10.

Reference numeral 12 is a pair of attaching hooks which are protruded onto the upper portion on the back face of the cover housing 10. Reference numeral 13 is a pair of engaging sections which are protruding to the lower portion of the cover housing 10. When the plug type connector 2 is attached to the side plate 6 of the toner cartridge 5, each engaging section 13 is inserted into the corresponding engaging recess 14 of the side plate 6, and then each attaching hook 12 is engaged with the corresponding hook section 15 of the side plate 6.

The plug housing 9 of the plug type connector 2 includes: a front wall section 61; a right and a left side wall section 62; a contact holding wall 17, which is arranged in parallel with the front wall section 61, for holding the contacting section of the contacts 7, 8 laterally in line in the contact holding groove 16; and a lower wall section 63 opposing to the front wall section 61 with respect to the contact holding wall 17.

On the lower face of the plug housing 9, there is provided an opening edge section 65, which is formed by the front wall section 61, the right and left side wall section 62 and the end section 64 of the lower wall section 63, in such a manner that the opening edge section 65 surrounds the periphery of the contact holding wall 17. In each of the right and the left side wall section 62, there is provided an engaging groove 66 which extends from the opening edge section 65 in parallel with the side end edge of the contact holding wall 17 by a predetermined length, and the longitudinal rib 32 described later of the receptacle type connector 1 is inserted into and drawn out from the engaging groove 66. Gap S is formed between the edge section 67 of the engaging groove 66 and the side end edge 17*a* of the contact holding wall 17 opposing to the edge section 67.

The first portion 68 and the second portion 69 are opposed to each other with respect to the engaging grooves 66 of the right and the left side wall section 62. The first portion 68 continuing to the front wall section 61 composes the guide wall 18, the cross-section of which is a groove-shape, together with the front wall section 61. When the plug type connector is combined with the receptacle type connector 1, this guide wall 18 is inserted into and drawn out from the subsidiary inserting and drawing recess 44 described later of the receptacle type connector 1.

The circuit board 11 is attached to the back face of the plug housing 9. For example, IC chip 19 is attached to the rear face 11*b* of the circuit board 11. IC chip 19 and the lead ends 20, 21 of the contacts 7, 8 penetrate the circuit board 11 and are soldered to the circuit on the surface of the circuit board 11. Reference numeral 70 is an elastic hook arranged in the lower wall section 63 of the plug housing 9, and this elastic hook 70 penetrates the circuit board 11 and engages with the surface 11*a*. The circuit board 11 substantially composes a rear wall section of the housing 9 of the plug type connector 2.

Referring to FIGS. 1 and 3, the receptacle type connector 1 is open upward so that the contact holding wall 17 of the plug type connector 2 can be inserted and drawn out. The receptacle type connector 1 includes: a housing 24 having a primary inserting and drawing recess 23 for holding the contacts 22 laterally in line; and a plug 27 to be engaged with the recess so that the end portions of all lead wires 26 can be connected with the end portions of the lead sections 25 of the contacts 22 protruding into the recess 60 formed on the lower face of the housing 24.

Referring to FIGS. 3, 4 and 5, the housing 24 includes: a front wall section 28; a rear wall section 29 opposed to the side plate 4 of the image forming device body 3; right and left side wall sections 30; and an intermediate wall section 31, which is a contact holding wall parallel with both the wall sections 28, 29, interposed between the front outer wall section 28 and the rear outer wall section 29.

Both side edges of the intermediate wall section 31 and both side edges of the front outer wall section 28 are connected with each other via the longitudinal ribs 32 provided on the inner face of the corresponding side wall section 30. The periphery of the primary inserting and drawing recess 23 is defined by the front outer wall section 28, the intermediate wall section 31 and a pair of longitudinal ribs 32.

Referring to FIG. 5, the corners 71 of the longitudinal rib 32 are respectively connected with the corners 72, 73 of the corresponding side edges of the front wall section 28 and the intermediate wall section 31. Each side edge 74 of the front wall section 28, the inner face of the side wall section 30 opposing to it and the longitudinal rib 32 define the longitudinal groove 75 into which the second portion 69 of the plug type connector 2 is inserted and engaged. The bottom of the primary inserting and drawing section 23 is composed of the intermediate bottom wall section 33 (shown in FIG. 6) provided in the intermediate section of the housing 24 in the height direction.

Referring to FIG. 4, each contact 22 includes: a primary section 35, the profile of which is a groove-shape, fixed to the fixing hole 34 of the intermediate bottom wall section 33; an elastic piece section 36, the profile of which is a wave-form; and a lead section 25 protruding into the recess 60 on the lower face of the housing 24. The elastic piece sections 36 are respectively held by the contact holding grooves 37, which are formed in the intermediate wall section 31 laterally in line, in the primary inserting and drawing recess 23. The top portion of the wave-form of the elastic piece section 36 composes the contact section 38 with respect to the opponent contact 7, 8.

Referring to FIGS. 3 and 4, in the connecting portion of the front outer wall section 28 with the intermediate bottom wall section 33, there is provided a through-hole 39 for discharging toner which penetrates the front outer wall section 28 and is open to the outside. As shown in FIG. 4, the inner bottom face 40 of the through-hole 39 is inclined as it comes outside, so that toner can be easily discharged outside from the primary inserting and drawing recess 23. Referring to FIGS. 3 and 4, reference numeral 41 is a lightening hole. Each side wall section 30 is provided with a pair of upper and lower stays 42, 43.

Referring to FIG. 6 showing a state in which both the connectors 1, 2 are combined with each other, the subsidiary inserting and drawing recess 44, the cross-section of which is a groove-shape, is formed being defined by the intermediate wall section 31, the rear outer wall section 29 and both the side wall sections 30 having the longitudinal ribs 32. This subsidiary inserting and drawing recess 44 is provided so that the guide wall 18 of the plug type connector 2 can be inserted into and drawn out from the subsidiary inserting and drawing recess 44.

The lower portion of this subsidiary inserting and drawing recess 44 for the use of the guide wall 18 is open to the outside via the through-holes 47 penetrating downward between a plurality of ribs 45, 46. The ribs 45 connect the intermediate wall section 31 with the rear outer wall section 29, and the ribs 46 connect the side wall section 30 with the intermediate wall section 31.

The contact holding wall 17 and the guide wall 18 of the plug type connector 2 are engaged in the primary inserting and drawing recess 23 and the subsidiary inserting and drawing recess 44 of the receptacle type connector 1, so that the contacts 7, 8 of the plug type connector 1 and the contacts 22 of the receptacle type connector 2 can be contacted with each other. As shown in FIG. 6, the exits of the through-holes 39, 47 are arranged at positions except for the engaging portion of both the connectors 1, 2.

Figure 7:
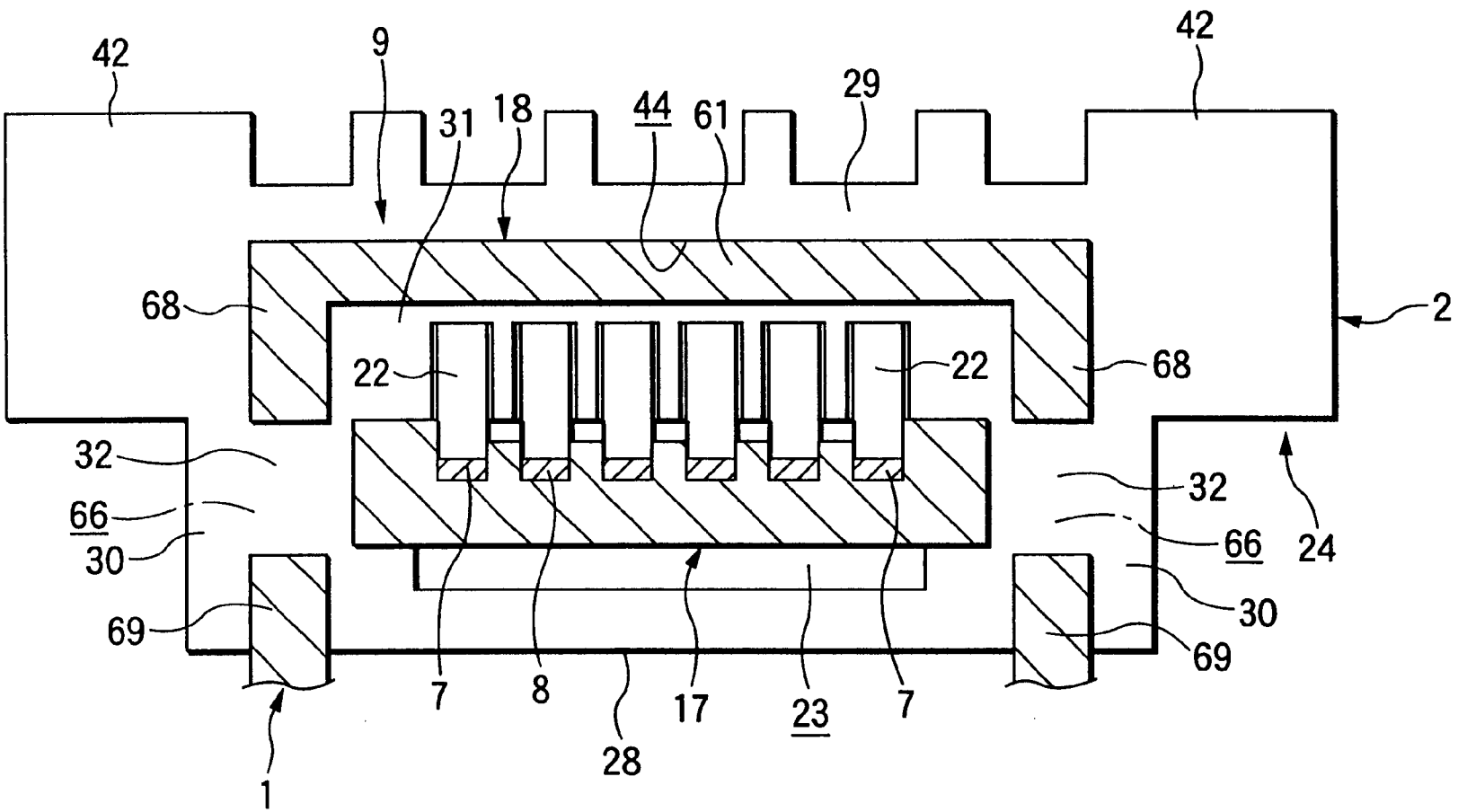
FIG. 7 is a lateral cross-sectional view showing an outline of a receptacle type connector and a plug type connector which are engaged with each other, wherein hatching is omitted on the cross-section of the plug type connector.

In this embodiment, when both the connectors 1, 2 are engaged with each other, the contact holding wall 17 and the groove-shaped guide wall 18 of the plug type connector 2 are respectively inserted into the primary inserting and drawing recess 23 and the groove-shaped subsidiary inserting and drawing recess 44 of the receptacle type connector 1 as shown in FIG. 7. Due to the foregoing, both the connectors can be strongly connected.

Concerning the plug type connector 2, since the periphery of the contact holding wall 17 is surrounded by the front wall section 61, the lower wall section 63 and the right and left side wall sections 62, the contacts 7, 8 can be positively protected after the plug type connector 2 has been disconnected from the receptacle type connector 1. Since the engaging grooves 66 are provided in the right and left side wall sections 62, it is unnecessary that the housing 9 is formed into an L-shape when it is viewed from the side. Therefore, the connecting structure can be made compact.

On the other hand, concerning the receptacle type connector 1, since the periphery of the intermediate wall section 31, which is a contact holding wall, is surrounded by the front wall section 28, the rear wall section 29 and the right and left side wall sections 30, the contacts 22 can be positively protected after the receptacle type connector 1 has been disconnected from the plug type connector 2. Further, since the corner sections 72, 73 of the corresponding side edges of the front wall section 28 and the intermediate wall section 31 are connected with each other by the corner sections 71, 71 of the longitudinal rib 32 formed on the inner face of the side wall section 30, the structure to define the inserting recess sections 23, 44 can be made compact and the mechanical strength can be enhanced. The plug type connector 2 is replaced with a new one together with the toner cartridge. On the other hand, the receptacle type connector 1, which is arranged in the image forming device body, is successively used. For the above reasons, it is very preferable that the mechanical strength of the receptacle type connector 1 is high.

In this connection, the present invention is not limited to the above specific embodiment. For example, the toner cartridge to which the plug type connector, which is an opponent of the receptacle type connector, is attached may be composed of a single body, or alternatively the toner cartridge may be composed of a unit in which the toner cartridge and at least one component (such as a developing device, cleaning device, photoreceptor or charger) composing the image forming device are integrated with each other. Alternatively, the plug type connector may be attached to a component of the image forming device except for the toner cartridge. Further, variations may be made by one skilled in the art without departing from the spirit and scope of the present invention.

What is claimed is:

1. A receptacle type connector to which a plug type connector is connected or from which the plug type connector is disconnected when the plug type connector attached to a side of an object is raised or lowered, the receptacle type connector comprising:

a housing provided with a front wall section, rear wall section, right and left side wall sections and an intermediate wall section for holding contacts in parallel with the front and the rear wall sections, wherein corners of longitudinal ribs respectively formed on inner faces of the right and left side wall sections connect corners of side edges of the front wall section with corners of corresponding side edges of the intermediate wall section, a primary inserting and drawing recess into which a contact holding wall of the plug type connector is inserted and from which the contact holding wall of the plug type connector is drawn out is defined by the front wall section, the intermediate wall section and the right and left longitudinal ribs, and a subsidiary inserting and drawing recess, a profile of which is in a groove-shape, into which a guide wall of the plug type connector is inserted and from which the guide wall of the plug type connector is drawn out is defined by the rear wall section, the intermediate wall section, the right and left side wall sections and the right and left longitudinal ribs.

2. The plug type connector combined with the receptacle type connector according to claim 1, the plug type connector comprising:

a housing provided with a front wall section, right and left side wall sections, contact holding wall which is parallel with the front wall section and inserted into and drawn out from the primary inserting and drawing recess of the receptacle type connector, and a lower wall section opposing to the front wall section with respect to the contact holding wall, wherein an opening edge section surrounding a periphery of the contact holding wall is formed by the front wall section, the right and left side wall sections and an end section of the lower wall section, an engaging groove extending from the opening edge section in parallel with a side end edge of the contact holding wall by a predetermined length is formed on the right and left side walls and the longitudinal ribs of the receptacle type connector are inserted into and drawn out from the engaging groove, a gap is formed between an edge section of the engaging groove and the side end edge of the contact holding wall opposing to the edge section of the engaging groove, and a first portion continuing to the front wall section in the first portion opposed to a second portion with respect to the engaging grooves of the right and the left side wall sections is formed into a groove-shaped guide wall which is inserted into and drawn out from the subsidiary inserting and drawing recess of the receptacle type connector together with the front wall section when the plug type connector is combined with the receptacle type connector.

3. The plug type connector according to claim 2, wherein the second portion is inserted into and drawn out from a longitudinal groove of the receptacle type connector.

4. The receptacle type connector according to claim 1, wherein a longitudinal groove is defined by the side edge of the front wall section, the inner face of one of the right and left side wall sections opposing to the side edge, and the longitudinal ribs.

5. The plug type connector combined with the receptacle type connector according to claim 2, the plug type connector comprising:

a housing provided with a front wall section, right and left side wall sections, contact holding wall which is parallel with the front wall section and inserted into and drawn out from the primary inserting and drawing recess of the receptacle type connector, and a lower wall section opposing to the front wall section with respect to the contact holding wall, wherein an opening edge section surrounding the periphery of the contact holding wall is formed by the front wall section, the right and left side wall sections and an end section of the lower wall section, an engaging groove extending from the opening edge section in parallel with a side end edge of the contact holding wall by a predetermined length is formed on the right and left side walls and the longitudinal ribs of the receptacle type connector are inserted into and drawn out from the engaging groove, a gap is formed between an edge section of the engaging groove and the side end edge of the contact holding wall opposing to the edge section of the engaging groove, and a first portion continuing to the front wall section in the first portion opposed to a second portion with respect to the engaging grooves of the right and the left side wall sections is formed into a groove-shaped guide wall which is inserted into and drawn out from the subsidiary inserting and drawing recess of the receptacle type connector together with the front wall section when the plug type connector is combined with the receptacle type connector.

6. The plug type connector according to claim 5, wherein the second portion is inserted into and drawn out from the longitudinal groove of the receptacle type connector.

* * * * *